United States Patent [19]

Itoh et al.

[11] Patent Number: 4,505,760

[45] Date of Patent: Mar. 19, 1985

[54] PROCESS FOR PARTIAL HOT DIPPING OF STEEL STRIPS

[75] Inventors: Masahiko Itoh, Hitachiota; Heihatiro Midorikawa, Hitachi; Akira Minato, Hitachi; Mituru Kubo, Hitachi; Takehiko Ito, Sakai; Kiichiro Katayama, Funabashi, all of Japan

[73] Assignees: Hitachi, Ltd.; Nisshin Steel Co., Ltd., both of Tokyo, Japan

[21] Appl. No.: 450,449

[22] Filed: Dec. 16, 1982

[30] Foreign Application Priority Data

Dec. 23, 1981 [JP] Japan ..... 56-206986

[51] Int. Cl.[3] ..... C23C 1/10

[52] U.S. Cl. ..... 148/6.15 R; 148/31.5; 427/156; 427/300; 427/433; 428/631; 428/632

[58] Field of Search ..... 427/156, 433, 329, 300, 427/259, 282; 148/6.14 A, 6.15 R, 6.15 Z, 6.16, 6.2, 31.5; 428/628, 629, 630, 631, 632, 684, 685

[56] References Cited

U.S. PATENT DOCUMENTS

| | | | |
|---|---|---|---|
| 3,583,932 | 6/1971 | Benton et al. | 260/8 |
| 4,101,345 | 6/1978 | Huater et al. | 427/433 |
| 4,404,030 | 9/1983 | Komura et al. | 427/300 |

FOREIGN PATENT DOCUMENTS

| | | | |
|---|---|---|---|
| 52-47528 | 4/1977 | Japan | 427/433 |
| 54-41235 | 4/1979 | Japan | 427/300 |
| 79/00673 | 9/1979 | Japan | 427/433 |
| 55-148751 | 11/1980 | Japan | 427/300 |

*Primary Examiner*—Norman Morgenstern
*Assistant Examiner*—K. E. Jaconetty
*Attorney, Agent, or Firm*—Antonelli, Terry & Wands

[57] ABSTRACT

A process for the partial hot dipping of a long steel strip is disclosed which comprises forming an oxidation-inhibiting film, oxygen-impermeable and thermally stable in a hot-dipping bath, which film is produced by the chemical reaction of an iron content in the steel strip with an oxidation inhibiting film-forming agent, such as an inorganic phosphoric acid compound, on a predetermined area of the steel strip surface, forming, as required, an intermediate layer comprising an inorganic binder, such as water glass, on the resulting film, forming a carbon-containing, plateing-stopping film as a top coat on the intermediate layer, and hot dipping the steel strip.

8 Claims, 9 Drawing Figures

PROCESS FOR PARTIAL HOT DIPPING OF STEEL STRIPS

BACKGROUND OF THE INVENTION

1. Field of the Invention

This invention relates to a continuous and high speed process for the partial hot dipping of long steel strips having areas which require no plating thereon, comprising forming a plating-stopping film on the area and then dipping the long steel strips in a hot-dipping bath.

2. Description of the Prior Art

For the purpose of obtaining corrosion resistance, steel sheets have often been plated with various anticorrosive films, which are generally formed on both sides of the steel sheets. In some cases of, for example, steel sheets for automobiles, where paints are applied after plating the plated surfaces to be additionally painted become inferior in brightness, markedly deteriorating commercial values of the sheets. On the other hand, for instance, galvanized steel sheets have poor weldability because zinc has a small difference between its boiling and melting points these steel sheets have a higher heat conductivity and moreover the welding tends to contaminate welding electrodes. As mentioned above, the application of the anticorrosive film has adverse effects on the appearance after painting and on the weldability. This has resulted in promoting the use of so-called single-side-plated steel sheets in the automotive industry and others. This type of sheet has one side face plated to make it anticorrosive while maintaining good paintability and weldability of the other side face.

An example of hot-dipping process for producing single-side-plated steel sheets (e.g. single-side-galvanized sheets) has been disclosed in Japanese Patent Laid-Open No. 158857/81. The process comprises forming a plating-stopping film consisting of a carbon layer on a steel strip surface at the area which requires no plating. This process is very effectual for single-side plating in that the carbon layer has not only a good plating-stopping function but also can be readily removed off after plating.

The present inventors have discovered that the steel strip surfaces not plated undergo an undesirable oxidation after removing the steel strips from a hot-dipping bath.

When no oxidation-inhibiting film is formed, the following inconvenience takes place, detracting product quality and productivity:

After the formation of a carbon-containing plating-stopping film on one side of a steel strip, the steel strip is dipped in a hot-dipping bath. The plated steel strip is exposed to the atmosphere, where the temperature of the strip initially the same as the hot-dipping bath is cooled naturally. The temperature of the strip just when taken up from the hot-dipping bath is about 450° C. for a zinc hot-dipping bath, about 650° C. for an aluminum hot-dipping bath, and about 330° C. for a tin hot-dipping bath. In all the cases, the strip is exposed at high temperatures to the atmosphere. This causes oxidation of the unplated surface of the strip (the surface of the strip coated with a plating-stopping film) to form an oxide film (scale), when the plating-stopping film does not have the oxidation-inhibiting property. The scale formed on the opposite surface of a single-side plated strip will bring about significant difficulties into such processes as chemical treatments, which are pretreatments for paint application to be made later, and electroplating of this unplated surface. Therefore, there is a need for removing this scale and for adding such steps as acid-cleaning after the plating step of a continuous plating process, thus markedly lowering productivity. When the scale is removed by acid-cleaning, the acid is required to contact with the scale alone because, if the steel strip is simply dipped in the acid, also the plating metal will be dissolved, thereby greatly increasing the cleaning loss; in consequence, the equipment becomes complicated in its construction.

According to the process of the heretofore mentioned Japanese Patent Laid-Open No. 158857/81, a scale that is about 500 Å thick forms during zinc hot-dipping.

When a water glass solution is applied as in the process of the Japanese Patent Laid-Open No. 158857/81, the resulting coating, on being exposed to a high temperature in a heat treatment step in the plating process, foams to become partly porous or develops tortoise shell-like cracks, and oxygen passes through these portions to reach the surface of a steel base, forming a scale. This phenomenon occurs similarly when an aqueous borax solution is applied.

When a silicone resin is applied, the coating is decomposed by heating in a heat-treatment furnace in the plating process, to form $SiO_2$, and at the same time a volume contraction of the coating take place, thereby developing such defects as cracks in the coating and forming a scale around the defects. In the conventional process, much time is consumed for dissolving and removing the scale, and heating is required for saving time.

SUMMARY OF THE INVENTION

The primary object of this invention is to provide a continuous and high speed process for the effective production of partially hot-dipped long steel strips of high quality with an unplated surface area free from the oxidation which has been a problem of the prior art.

Thus, according to this invention, there is provided a continuous and high speed process for the partial hot dipping of a long steel strip which comprises the successive steps of:

(a) forming an oxidation-inhibiting film, oxygen-impermeable and thermally stable in a hot-dipping bath, which is produced by the chemical reaction of an iron content in the steel strip with an oxidation-inhibiting-film forming agent, on a predetermined area of the steel strip surface, (b) forming a carbon-containing, plating-stopping film as a top coat on the resulting film, and (c) dipping the steel strip having the oxidation-inhibiting film and the plating-stopping film, into a hot-dipping bath to form a metal coating on an exposed surface of the steel strip.

DETAILED DESCRIPTION OF PREFERRED EMBODIMENTS

Figure 1:
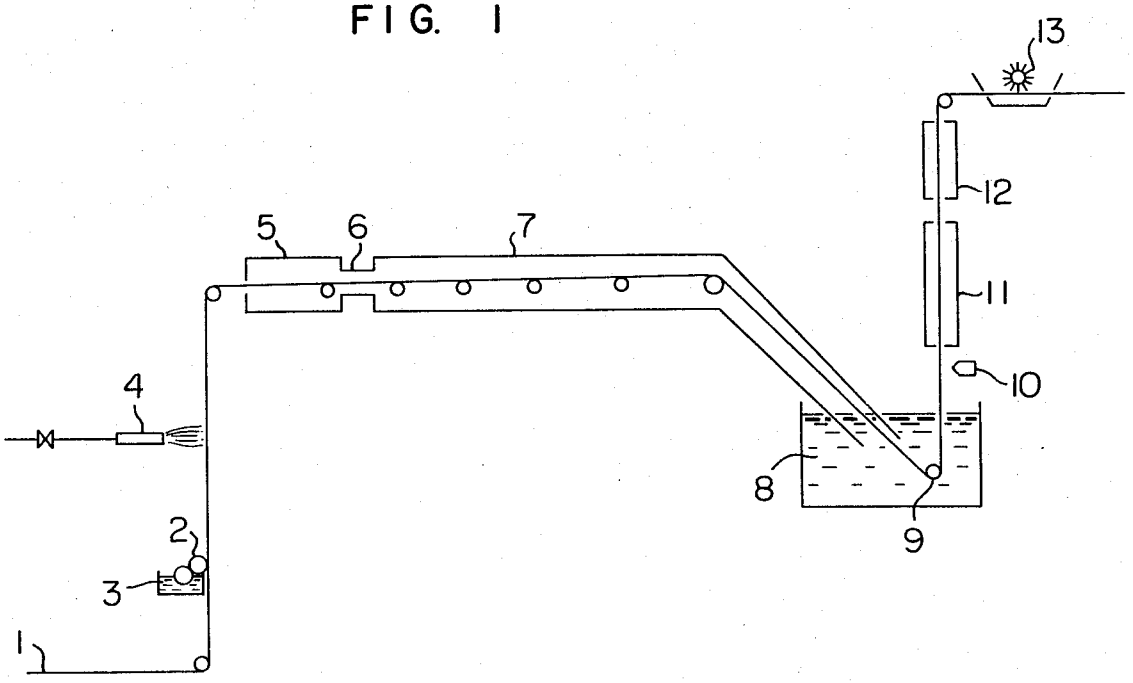
FIGS. 1-3 are schematic vertical sectional views of plating systems used in the Examples of this invention.

In the process of this invention, an oxidation-inhibiting film is first formed on an area, requiring no plating, of a long steel strip surface. The role of the oxidation-inhibiting film is to substantially shut off oxygen from the underlying surface of steel. Suitable oxidation-inhibiting-film forming agents for this purpose are materials capable of forming a compact barrier film playing said role by reacting with the steel base. Such film forming materials include phosphoric acid, metal phosphates, condensed metal phosphates, denatured phosphates derived from these metal phosphates, chromic acid, dichromic acid, metal chromates, metal dichromates, oxalic acid, and metal oxalates. Of the above metal salts, for example, the following water-soluble salts are preferable: Phosphates, condensed phosphates, or denatured phosphates of sodium, potassium, zinc, aluminum, calcium, chromium, titanium, iron, copper, barium, magnesium, and manganese, chromates or dichromates of sodium, potassium, and ammonium; and oxalates of sodium, potassium, ammonium, magnesium, and iron. The oxidation-inhibiting film forming agents can be applied onto an area, requiring no plating, of a steel strip surface, either directly in the form of an aqueous solution or after being added to an inorganic film forming liquid which will be described later in detail. These agents, on applying in either of the above-mentioned ways, react with steel, forming an oxidation-inhibiting film thereon.

In the next place, a plating-stopping film is formed on the oxidation-inhibiting film. This plating-stopping film is best formed from carbon in a fine powder or soot just formed by the incomplete combustion of hydrocarbons. In practice, the plating-stopping carbon layer is preferably formed while the oxidation-inhibiting film is substantially wet, thereby providing a plating-stopping film of good adhesion.

It is desirable to form an intermediate layer (hereinafter referred to as an inorganic binder film) between the oxidation-inhibiting film and the plating-stopping film. The inorganic binder film is formed by coating the oxidation-inhibiting film with, for example, an aqueous water glass or borax solution or a dispersion of a thermally stable inorganic fine powder in a water glass solution or in an aqueous borax solution, thereby providing the plating-stopping film with a stable plating-stopping function and with an improved removability after plating. In this case also, the carbon layer is preferably formed while the inorganic binder film is substantially wet. The above inorganic binder is applied onto the oxidation-inhibiting film by roll coating, spray coating, or the like. The water glass solution is prepared by diluting a concentrated aqueous solution of a sodium silicate, usually called "raw liquor", with water. The dilution is suitably selected so that the resulting solution may be applied without any trouble to give a dense film with good adhesion to the upper and lower layers after drying or vitrification by heating. Similarly, the aqueous borax solution is applied at a concentration suitably selected considering such coating workability, adhesion, and compactness. Said inorganic binder film is desirably substantially dried before it is dipped into the hot dipping bath. The inorganic binder film acts as a barrier for preventing the permeation of oxygen to the underlying surface of a steel base and as a binder for the thermally stable inorganic fine powder. Accordingly, the particle size and amount of this inorganic fine powder to be dispersed in the water glass or borax solution should be selected by taking an account of said coating workability, adhesion, compactness, etc. In view of the above, the particle size of the inorganic fine powder is desired to be up to 1.5 μm. The particle size exceeding 1.5 μm deteriorates the smoothness of the inorganic binder film, thus resulting in the following drawbacks: The face of the soot layer laid on the binder film becomes coarse and hence is accompanied by more molten metal when the steel strip is taken up from the hot-dipping bath; and since fine voids are produced in the inorganic binder film, it becomes impossible to prevent the permeation of oxygen. In practice, satisfactory particle sizes of the inorganic fine powder are 0.1–1.5 μm. The amount of the powder to be added to the water glass or borax solution is chosen, depending upon the easiness of stripping the plating-stopping film from the steel strip (hereinafter, the easiness is referred to as removability), besides considering the above-mentioned coating workability, adhesion, and compactness. Excessive amounts of the powder added impair the coating workability, adhesion, and compactness, while too small amounts thereof deteriorate said removability. The amount of the powder is generally in the range of 5–70%, preferably 25–45%, by weight.

The inorganic fine powder, which has to be thermally stable, is desired to contain one or more members selected from the group consisting of $SiO_2$, $Al_2O_3$, CaO, $K_2O$, MgO, $Na_2O$, $TiO_2$, BeO, and $LiO_2$; as an example, a fine powder of clay is particularly useful. It is favorable, since the fine powder of about 0.1–about 1.5 μm in particle size is readily available.

In this invention, it has been found that fluidities of the water glass solution or borax solution to which the inorganic fine powder and/or oxidation-inhibiting film-forming agent may be added can be improved by maintaining the pH of each solution at a value of up to 4, particularly up to 3. However, when the pH is too low, these solutions tend to dissolve the steel surface, in other words, the solutions become corrosive; thus the pH is suited to be 2–4. The adjustment of the pH is effected by the addition of an acid since these solutions are neutral or weakly alkaline. For this purpose, mineral acids and organic acids can be used, but phosphoric acid is undesirable because the proper concentration of phosphate ions becomes unbalanced. While almost all other mineral acids are acceptable, hydrochloric acid is preferred in view of its weak tendency to remain on a steel surface. This purpose, in this invention, is also sufficiently achievable with organic acids such as citric acid and oxalic acid.

The inorganic binder film, after being coated with a carbon powder, is dried to solid or heated to solid with the water glass or borax vitrified, thus completing the top coat, plating-stopping film, with good adhesion.

A carbon powder, either crystalline or amorphous may be used for the top coat. The particle size of the carbon powder for this purpose is preferably as small as possible since the too large particle size leads to a decrease in the contact area of the particles, thus deteriorating their adhesion. In practice, several microns or less is sufficient for the particle size.

The formation of the plating-stopping film consisting of the carbon powder is accomplished by spray coating, roll coating, or the like. The method of spraying soot just produced by the incomplete combustion of hydrocarbons is most desirable with respect to the adhesion of carbon particles. This method is also advantageous in that it accelerates the solidification of the inorganic binder film when this binder is previously applied.

As described above, the process of this invention comprises;

forming an oxidation-inhibiting film having good adhesion and sufficient compactness for preventing the permeation of oxygen, on the surface of steel strips requiring no plating;

forming a carbon layer having a superior plating-stopping property on the oxidation-inhibiting film; or forming an inorganic binder film from a thermally stable inorganic fine powder and from either water glass or borax, on the oxidation-inhibiting film, followed by forming a similar carbon layer as the above.

Because of such a construction, the resulting coating films are improved in adhesion, the surface of steel strips coated with these films is not oxidized even when the steel strip are subjected to hot-dipping or other high temperature treatments, and these coating films are readily stripable after hot-dipping, whereby partially plated steel strips of high quality can be obtained in a high production rate.

Referring now to the accompanying drawings, preferred embodiments of this invention will be illustrated below.

(1) FIG. 1 is a schematic vertical sectional view of the plating system used in the Examples of this invention. As shown in FIG. 1, a long steel strip 1 coated with an inorganic binder composition 3 by means of a reverse coater 2. The inorganic binder composition 3 has been prepared by dissolving magnesium phosphate in a water glass solution and dispersing therein a clay of 0.1–1.5 μm in particle size. The inorganic binder layer on the steel strip 1 is then coated with soot by means of a masking burner 4 while the binder is in a wet state, that is, before the binder solidifies completely. The masking burner 4 is fed with a hydrocarbon, e.g. propane, butane, acetylene, or natural gas, along with oxygen or air, and efficiently produces soot from the combustion flame by regulating suitably the mixing ratio of the hydrocarbon to oxygen or air. Hydrocarbons of a higher carbon atom content are preferable for the production of the soot; acetylene is especially effective. Propane and butane are advantageous in that they give each a fine powder of carbon which can form a compact film. The combustion flame is blown against the film produced from the binder 3 to form a soot film which serves as a plating-stopping film. The incomplete combustion temperature is adjusted generally to 900°–1200° C., preferably to 1000°–1100° C.

Then, the steel strip 1 is introduced into a non-oxidative furnace 5, where the oil and such, attached onto the surface to be plated of the steel strip are burned up. The steel strip is then passed through a throat 6 to enter a reduction furnace 7, where the oxides on the surface to be plated are reduced to clean the surface.

The steel strip 1 is then dipped into a hot-dipping bath 8 (molten metal bath), is passed on a sink roll 9, and taken up to the atmosphere, where the plating amount is controlled by use of a gas-jetting device 10. When the steel strip 1 is taken up, the surface requiring no plating of the steel strip 1 does not pick up the molten metal from the hot-dipping bath 8 and is not oxidized with atmopheric oxygen, since this is coated successively with the oxidation-inhibiting film formed by the oxidation-inhibiting-film forming agent (magnesium phosphate) added to the water glass solution and clay and with the plating-stopping film formed from soot.

Then, the steel strip 1 is introduced into an alloying furnace 11 and heated again to a high temperature; for example, at about 500° C. for 10–60 sec. when a galvanized strip is produced. Under such a high temperature condition, the surface requiring no plating is protected from oxidation. The alloying treatment is necessary or unnecessary depending upon the purposes of the application of the product, plated steel strips.

The steel strip 1 is cooled by a cooler 12 to room temperature, and the double layers laid on the surface requiring no plating are stripped therefrom by means of a brushing roll 13, thus giving a single-side-plated steel strip.

Further, in accordance with this invention, the steel strip may be allowed to pass through a reducing atmosphere after forming the plating-stopping film and before dipping the steel strip into a bath to reduce an oxide film produced at least on a surface to be plated. This imparts good effects to a plating. That is, a rolled steel strip has a rolling mill oil adhered thereto and the oil is removed from the strip by a combustion treatment, which causes the oxide film to be produced on the strip. This oxide film has an adverse effect on forming a plating, i.e., may cause bad plating. The reduction step as described above can eliminate the bad plating. The above-mentioned reduction furnace 7 is effective for the reduction step of this invention, and this reduction step allows a soot deposited on the steel strip to be maintained in a reduced state, thereby preventing the loss of the soot due to oxidation.

Figure 2:
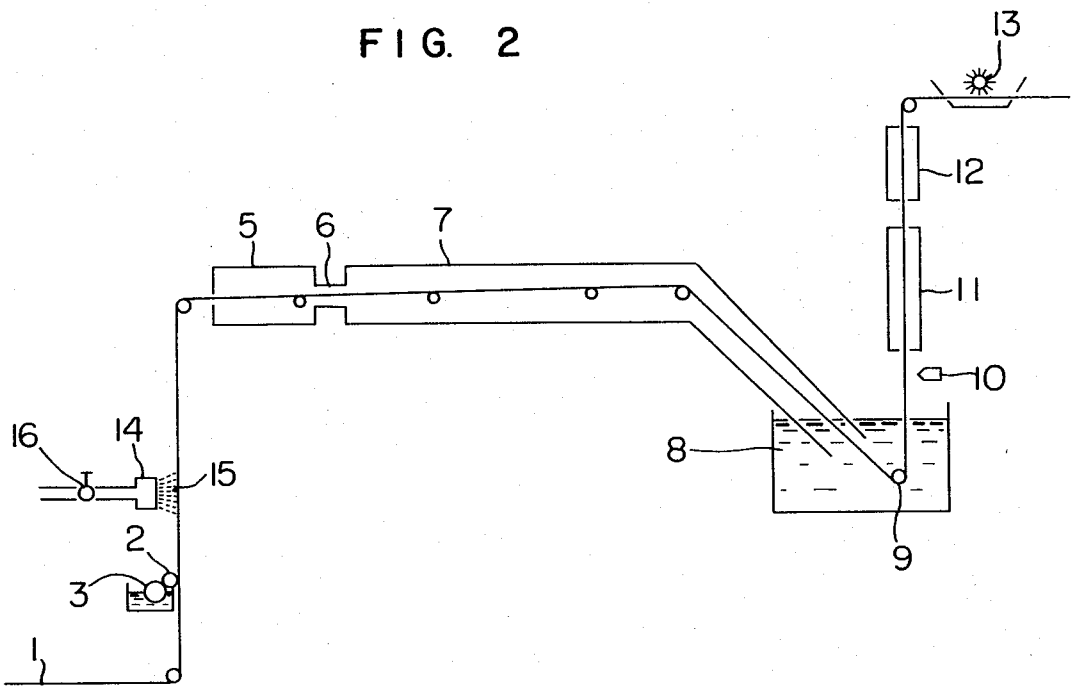

(2) FIG. 2 is a schematic vertical sectional view of another plating system used in the Examples of this invention. The process by this system is basically the same as described referring to FIG. 1, but is different therefrom in the type of carbon used for forming the plating-stopping film as a top coat and accordingly, in the carbon powder sprayer.

A surface requiring no plating of a steel strip 1 is coated with the above-mentioned inorganic binder composition 3 by means of a reverse coater 2. The inorganic binder layer formed is sprayed with a powder of carbon 15 by means of a fine powder jetting head 14 while the layer is in a wet state, thereby forming a plating-stopping film as a top coat. This powder of carbon is desired to have an average particle size of up to 1 μm. When the driving pressure for jetting is too high, the binder layer in a wet state often becomes irregular in thickness by local movements. In such a case, the jetting pressure is controlled by means of a pressure regulating valve 16. The steel strip 1 is treated thereafter as described referring to FIG. 1, giving a single-side-plated steel strip.

Figure 3:
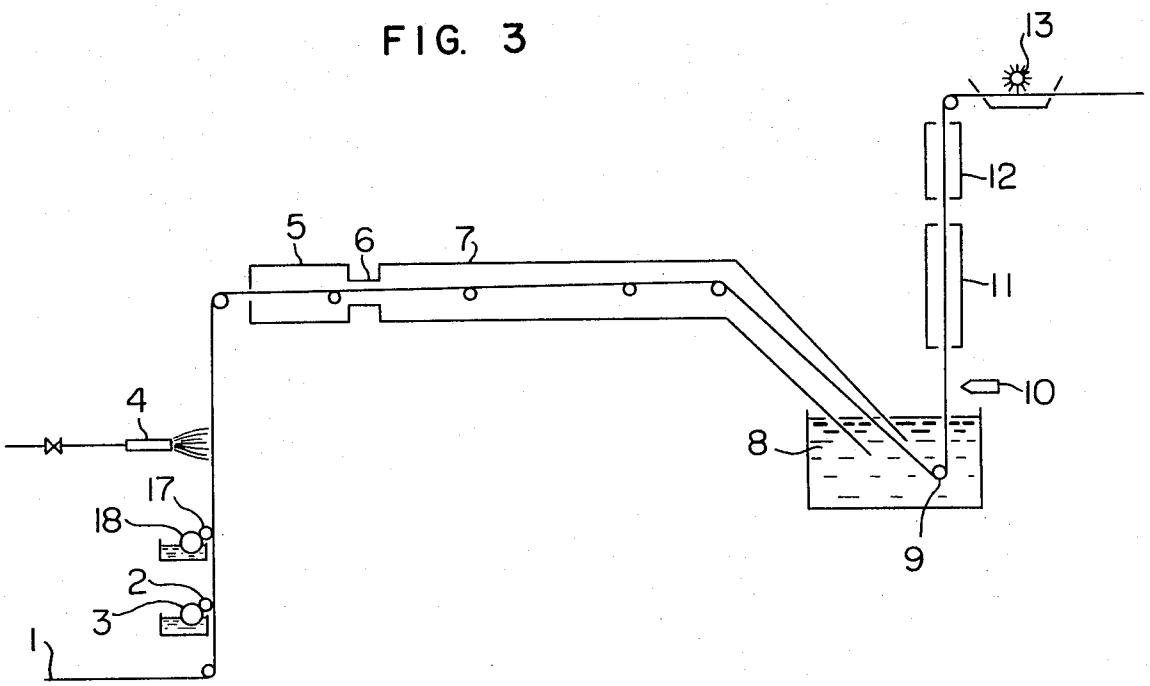

(3) FIG. 3 is a schematic vertical sectional view of a still other plating system of this invention. The process by this system is also basically the same as described referring to FIG. 1, but is different in the composition of oxidation-inhibiting film and in forming an intermediate layer.

A face requiring no plating of a steel strip 1 is coated with an inorganic binder composition 3 (A) by means a reverse coater 2. The above-mentioned oxidation-inhibiting film forming agent is an aqueous manganese (II)

hydrogenphosphate. The steel strip 1 having the oxidation-inhibiting film forming agent applied thereon is further coated thereover with an inorganic binder composition 18. The inorganic binder composition 18 has a clay powder of 0.1 to 1.5 μm in average particle size dispersed in a water glass solution. Then, the intermediate layer formed from the binder composition 18 is coated with a soot film as the top coat by means of a masking burner 4 while the intermediate layer is wet. Thereafter, the steel strip is treated as described referring to FIG. 1, giving a single-side-plated steel strip.

Table 1 shows the results of Examples 1–4 of this invention together with the results of Comparative Examples 1–5 by the prior art. In these Examples and Comparative Examples, steel strips were galvanized by using the plating system shown in FIG. 1, 2, or 3, except that in the Comparative Examples the devices for carrying out the operation steps featuring the process of this invention were not used.

The masking device (soot producing device) has a structure, for example, as shown in FIGS. 4–8.

Figure 4:
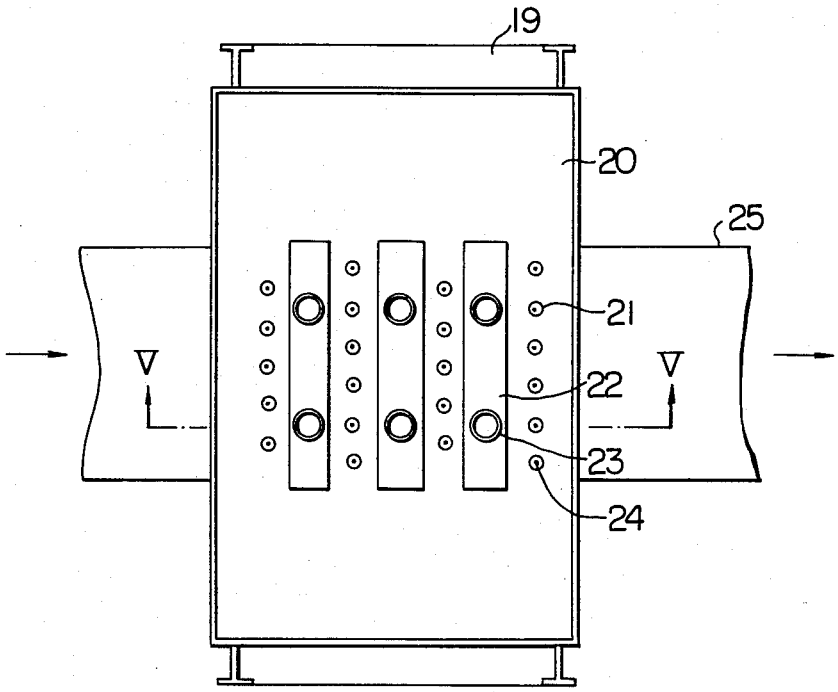
FIG. 4 is a plan view of a masking device used in the Examples of this invention.
Figure 5:
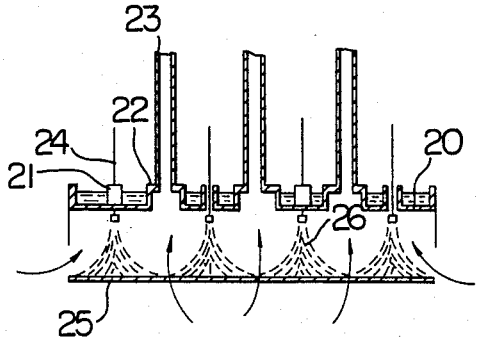
FIG. 5 is a cross-sectional view taken on line V—V of FIG. 4.

FIG. 4 is a plan view of a masking device in the plating system shown in FIG. 1, and FIG. 5 is a cross-sectional view taken on line V—V of FIG. 4. In these drawings, 19 denotes ducts for exhausting combustion offgas, 20 is a heat shielding plate, 21 denotes burner insertion ports, 22 denotes air ducts, 23 denotes air pipes, 24 denotes burners, 25 is a steel strip, and 26 shows incomplete combustion flame. The steel strip 25 is coated with the soot produced by incomplete combustion of a hydrocarbon through the burners 24. The combustion offgas is exhausted through the ducts 19 positioned on both sides of the masking device. Part of the offgas is also exhausted through the air ducts 22 and air pipes 23, Meantime, negative pressure results between the steel strip 25 and the heat shielding plate 20, sucking air, as shown by arrows in FIG. 5, from outside into the neighborhood of the burners 24, thereby preventing the development of air-deficient state and permitting all the burners 24 to keep the incomplete combustion stable. Thus, the soot coating can be continued steadily.

According to experiments on the masking devices in this invention, a nearly uniform soot layer 0.8–1.0 μm thick could be formed on steel strips under the following conditions:

Masking device: Burners (22 in all) were aligned in the transverse direction of steel strip at 170-mm intervals in 4 rows (row-to-row intervals 400 mm), as shown in FIG. 4.

Distribution of burners: 1st row: 6 burners; 2nd row: 5 burners; 3rd row: 6 burners; 4th row: 5 burners.

Width of steel strip: 1000 mm

Distance between steel strip and burner head: 200 mm

Incomplete combustion conditions:

LPG 6 l/min. per burner $O_2$ 7 l/min. per burner

Flame tem.: 1000°–1100° C.

Steel strip speed: 100 m/min.

TABLE 1

| | Inorganic binder composition containing oxidation-inhibiting film forming agent and inorganic powder (wt %) | Oxidation-inhibiting film | Thickness of binder film (μm) | Thickness of soot film (μm) | Peeling* of inorganic film and soot film | Removability of oxidation-inhibiting film, inorganic film or soot film with brush | Weight of scale on galvanized surface (mg/cm²) | | Maximum plating speed (m/min) |
|---|---|---|---|---|---|---|---|---|---|
| | | | | | | | No alloying treatment | Alloying treatment | |
| Examples | | | | | | | | | |
| 1 | 5% water glass<br>10% aluminum phosphate<br>20% $SiO_2$<br>10% $Al_2O_3$<br>55% Water | yes | 10 | 0.8 | no | good | no | no | 100< |
| 2 | 5% water glass<br>10% magnesium phosphate<br>10% $Al_2O_3$<br>10% $SiO_2$<br>5% $TiO_2$<br>5% clay<br>55% water | yes | 10 | 0.8 | no | good | no | no | 100< |
| 3 | 5% water glass<br>6% magnesium phosphate<br>35% clay<br>54% water | yes | 10 | 0.8 | no | good | no | no | 100< |
| 4 | 5% borax<br>10% aluminum phosphate<br>35% clay<br>50% water | yes | 10 | 0.8 | no | good | no | no | 100< |
| 5 | 3% water glass<br>10% magnesium biphosphate<br>20% $SiO_2$<br>10% $Al_2O_3$<br>57% water | yes | 5 | 0.8 | no | good | no | no | 100< |
| 6 | 3% water glass<br>8% sodium biphosphate<br>10% $Al_2O_3$<br>15% $SiO_2$<br>5% $TiO_2$<br>59% water | yes | 5 | 0.8 | no | good | no | no | 100< |
| Comparative | | | | | | | | | |

TABLE 1-continued

| | Inorganic binder composition containing oxidation-inhibiting film forming agent and inorganic powder (wt %) | Oxidation-inhibiting film | Thickness of binder film (μm) | Thickness of soot film (μm) | Peeling* of inorganic film and soot film | Removability of oxidation-inhibiting film, inorganic film or soot film with brush | Weight of scale on unplated surface (mg/cm²) No alloying treatment | Weight of scale on unplated surface (mg/cm²) Alloying treatment | Maximum plating speed (m/min) |
|---|---|---|---|---|---|---|---|---|---|
| tive Example | | | | | | | | | |
| 1 | 5% water glass<br>95% water | no | 5 | — | only a little | poor | no | 250-300 | 20-30 |
| 2 | 5% water glass<br>40% MgO<br>55% water | no | 10 | — | a little | fair | 300-350 | 800-1000 | 30-40 |
| 3 | 5% water glass<br>30% $SiO_2$<br>65% water | no | 10 | — | no | fair | 250-300 | 700-800 | 30-40 |
| 4 | 25% $SiO_2$<br>25% $Al_2O_3$<br>50% water | no | 10 | — | a little | good | 300-500 | 3000-4000 | 40-50 |
| 5 | none | no | — | 0.8 | no | good | 500< | 4000< | 200< |

*Whether or not an inorganic binder film and a plating-inhibiting film are peeled in an oxidative furnace, reductive furnace, plating bath of cooling device.

Figure 6:
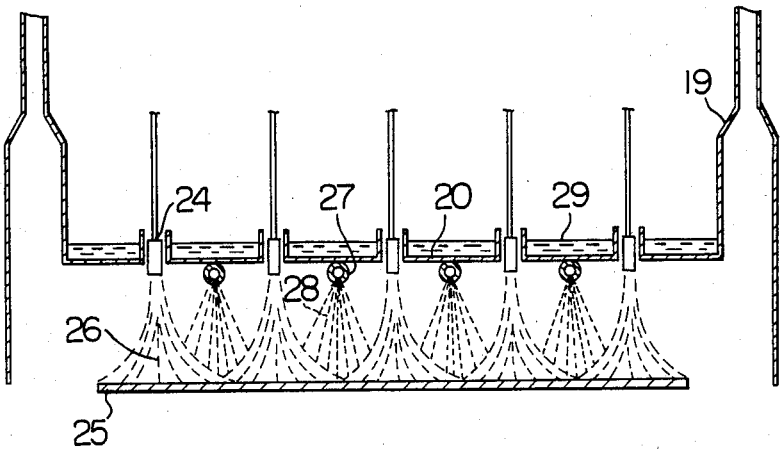
FIG. 6 is a cross-sectional view of another masking device used in the Examples of this invention.
Figure 7:
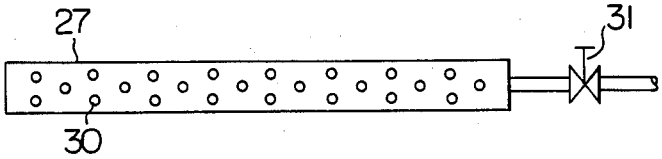
FIG. 7 is a plan view of each combustion promoting-gas blowing pipe of the device of FIG. 6.
Figure 8:
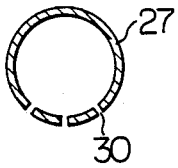
FIG. 8 is a sectional view of the pipe of FIG. 7.

FIG. 6 is a cross-sectional view of another masking device used in the Examples of this invention, FIG. 7 is a plan view of each combustion promoting-gas blowing pipe of the device shown in FIG. 6, and FIG. 8 is a cross-sectional view of the pipe shown in FIG. 7.

As shown in FIG. 6, a face requiring no plating of a steel strip 25, already coated with a binder composition, is exposed to the incomplete combustion flame 26 from masking burners 24, thereby forming a soot film on the binder layer. During this treatment; air 28 is supplied through a combustion promoting-gas blowing pipe 27; the radiation heat from the flame is shut off from the control section of the device with a heat shielding plate 20 and cooling water 29 circulating on the upper side of the plate; and the combustion offgas is exhausted through ducts 19.

As shown in FIG. 7, the combustion promoting-gas blowing pipe 27 in FIG. 6 is provided with a number of blowing orifices 30 at regular intervals, and the pressure of the air supplied through the pipe 27 is controlled by a pressure regulating valve 31 so as not to disturb the incomplete combustion flame.

As shown in FIG. 8, the blowing orifices 30 are disposed in the three directions from the axis of the blowing pipe, one being vertically downward and the two others being obliquely downward on both sides of the perpendicular at an angle of 20°.

By the use of the masking device described above, a number of burners all can be kept the same combustion state. This results in an improvement in soot production efficiency, more uniform thickness of soot layer, and effective utilization of fuel gas. Further, the improvement in soot production efficiency makes it possible to raise the operational strip speed and hence improve the productivity.

Example

A coating composition for the formation of the oxidiation-inhibiting film or inorganic binder film was prepared by dispersing 10% of $Al_2O_3$, 10% of $SiO_2$, 5% of $TiO_2$ and 5% of clay in an aqueous solution containing 3% of water glass and 6% of magnesium phosphate. Several samples taken from this coating composition were adjusted to different values of pH by adding hydrochloric acid while stirring. Then, the stirring was further continued to determine the time passed until each sample lost fluidity. The results thereof are shown in FIG. 9.

Figure 9:
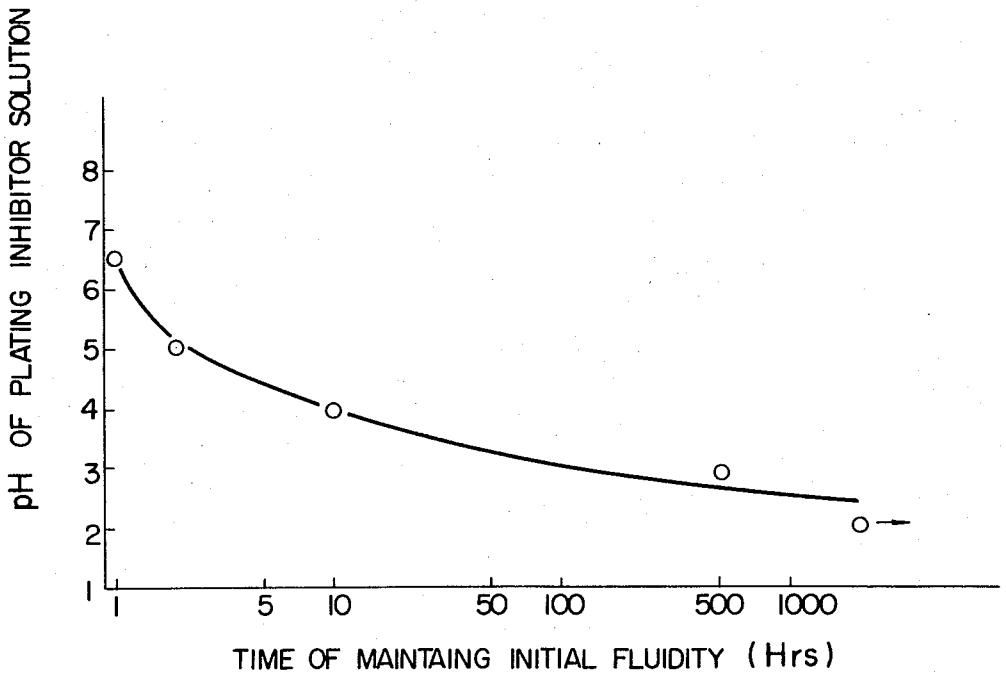
FIG. 9 is a graph showing the pH dependence of fluidity of a plating stopper solution in an Example of this invention.

As is seen from FIG. 9, the sample of pH 6.5, to which no hydrochloric acid was added, lost fluidity, i.e. its coating on steel strips became almost infeasible, in about one hour. In contrast, as pH was lowered by increasing the amount of hydrochloric acid, the coating composition exhibited longer time of retaining initial fluidity. At pH 4, this retention time was 10 hours, being allowable for practical use. When pH was lowered to 3 or less, the coating composition retained initial fluidity after 500 hours; no deterioration was observed in its applying workability for coating steel strips.

Coating compositions adjusted to pH 3 with hydrochloric acid as above were coated on cold-rolled steel sheets and soot was coated on the resulting composition layers by incomplete combustion of LPG. The thus prepared samples did not indicated any difference from those prepared without addition of hydrochloric acid in properties such as plating-stopping property, oxidation-inhibiting property, and adhesion.

As described hereinbefore, this invention has the following advantages:

It is possible to prevent steel strips from carrying along molten metals when taking up the strips from hot-dipping bath.

The speed of plating steel strips can be increased as largely as to a maximum speed of 200 m/min. since the plating-stopping coating can be removed quickly with ease.

It has become possible by the formation of an oxidation-inhibiting film to completely shut off atmospheric oxygen from the underlying surface of steel. Accordingly, the underlying surface undergoes no substantial oxidation even under such high temperature conditions as in alloying heat treatments and aluminum hot dipping.

Tests of the process of this invention conducted on hot-dipping with aluminum gave similarly good results.

The present invention is not limited to the foregoing Examples; it can also be applied to hot-dipping processes with zinc, aluminum, lead, tin, etc.

The term "partial hot dipping" in this invention means the hot dipping of one side, part of one side, or parts of both sides, of a long steel strip.

What is claimed is:

1. A continuous and high speed process for the partial hot dipping of a long steel strip, which comprises the successive steps of:

(a) forming an oxidation-inhibiting film, oxygen-impermeable and thermally stable in a hot-dipping molten metal bath, which is produced by chemical reaction of the iron in the steel strip with an oxidation-inhibiting-film forming agent, on a predetermined area of the steel strip surface, (b) forming a thermally stable inorganic binder on the oxidation-inhibiting film, said binder comprising an aqueous solution of water glass or borax which contains metal oxide or clay powder thermally stable in a hot-dipping molten metal bath, (c) forming a carbon-containing, plating-stopping film as a top coat over the oxidation-inhibiting film and the inorganic binder, and (d) dipping the steel strip having the oxidation-inhibiting film, the inorganic binder, and the plating-stopping film, in a hot-dipping molten metal bath to form a metal coating on an exposed surface of the metal strip.

2. The process for the partial hot dipping of a long steel strip, according to claim 1, wherein said oxidation-inhibiting film forming agent is an inorganic phosphoric acid compound capable of forming an iron phosphate film or an iron-metal phosphate film.

3. The process for the partial hot dipping of a long steel strip, according to claim 1, wherein the inorganic binder has a pH of up to 4.

4. The process for the partial hot dipping of a long steel strip, according to claim 7, wherein the oxidation-inhibiting film is formed by use of the oxidation-inhibiting-film forming agent added to the inorganic binder.

5. The process for the partial hot dipping of a long steel strip, according to claim 1 or 2, wherein the oxidation-inhibiting film is formed by a prior contact of the oxidation-inhibiting-film forming agent with a predetermined area of the steel strip surface.

6. A product obtained by the process according to claim 1 or claim 3.

7. A continuous and high speed process for the partial hot dipping of a long steel strip, which comprises the successive steps of:

(a) forming an oxidation-inhibiting film, oxygen-impermeable and thermally stable in a hot-dipping molten metal bath, which is produced by chemical reaction of the iron in the steel strip with an oxidation-inhibiting-film forming agent, on a predetermined area of the steel strip surface, (b) forming a thermally stable inorganic binder on said oxidation-inhibiting film, said binder comprising an aqueous solution of water glass or borax which contains metal oxide or clay powder thermally stable in a hot-dipping molten metal bath, (c) forming a carbon-containing, plating-stopping film as a top coat on the thermally stable inorganic binder, (d) allowing the steel strip to pass through a reducing atmosphere, thereby reducing the exposed steel strip surface to be plated, and (e) dipping the steel strip having the oxidation-inhibiting film, the inorganic binder, and the plating-stopping film into a hot-dipping molten metal bath to form a metal coating on an exposed surface of the steel strip.

8. A product obtained by the process according to claim 7.

* * * * *